US006964287B1

(12) United States Patent
Nesveda et al.

(10) Patent No.: US 6,964,287 B1
(45) Date of Patent: Nov. 15, 2005

(54) NON-TOXIC AND NON-CORROSIVE IGNITION MIXTURE

(75) Inventors: Jiri Nesveda, Vlasim (CZ); Stanislav Brandejs, Vlasim (CZ); Karel Jirasek, Kondrac (CZ)

(73) Assignee: Sellier & Bellot, A.S., Vlasim (CZ)

( * ) Notice: Subject to any disclaimer, the term of this patent is extended or adjusted under 35 U.S.C. 154(b) by 0 days.

(21) Appl. No.: 10/088,155

(22) PCT Filed: Sep. 11, 2000

(86) PCT No.: PCT/CZ00/00067

§ 371 (c)(1),
(2), (4) Date: Mar. 12, 2002

(87) PCT Pub. No.: WO01/21558

PCT Pub. Date: Mar. 29, 2001

(30) Foreign Application Priority Data

Sep. 17, 1999 (CZ) ..... 1999-3305

(51) Int. Cl.[7] ..... C06B 45/10; D03D 23/00
(52) U.S. Cl. ..... 147/19.8; 147/108.6
(58) Field of Search ..... 149/19.8, 22

(56) References Cited

U.S. PATENT DOCUMENTS

| | | | | |
|---|---|---|---|---|
| 3,611,939 A * | 10/1971 | Stadler et al. | ..... | 102/204 |
| 4,429,632 A * | 2/1984 | Yunan | ..... | 102/202.13 |
| 4,497,251 A * | 2/1985 | Rucker | ..... | 102/202.6 |
| 5,167,736 A | 12/1992 | Mei et al. | ..... | 149/22 |
| 5,216,199 A | 6/1993 | Bjerke et al. | ..... | 102/471 |
| 5,547,528 A | 8/1996 | Erickson et al. | ..... | 149/92 |
| 5,567,252 A | 10/1996 | Mei et al. | ..... | 149/22 |
| 6,224,099 B1 * | 5/2001 | Nielson et al. | ..... | 102/205 |
| 2001/0001970 A1 * | 5/2001 | Hagel et al. | ..... | 149/61 |

FOREIGN PATENT DOCUMENTS

| | | | |
|---|---|---|---|
| DE | 1243067 | | 6/1967 |
| DE | 19540278 | * | 4/1997 |
| EP | 0 656 332 A1 | | 10/1994 |
| FR | 2 021 662 A | | 7/1970 |

* cited by examiner

*Primary Examiner*—Francis T. Palo
(74) *Attorney, Agent, or Firm*—Morrison & Foerster LLP

(57) ABSTRACT

A non-toxic and non-corrosive ignition mixture is created by combining the energy system and the pyrotechnic system. The energy system comprises a high explosive from the groups of nitroesters and nitramines and a senzibiliser of the type of tetrazene or derivatives of tetrazoles for its activation. The pyrotechnic system comprises an oxidizing agent from the group of oxides and peroxides of metals, from the group of salts of inorganic oxygen-containing acids, and a fuel which is amorphous boron. The mixture is supplemented with a friction agent which is preferably ground glass. Nitrocellulose, polyvinyl alcohol and acacia gum are used as bonding agents. Mixtures are utilizable in the field of ammunition production for the production of primers, especially for central ignition cartridges.

17 Claims, No Drawings

NON-TOXIC AND NON-CORROSIVE IGNITION MIXTURE

This application is a U.S. National Phase Patent Application of PCT/CZ00/00067, filed Sep. 11, 2000, and claims benefit of priority under 35 U.S.C. 119 from PV 1999-3305, filed Sep. 17, 1999, which is hereby incorporated by reference as if fully set forth.

TECHNICAL FIELD

The invention concerns the field of ammunition production, especially the production of ignition mixtures for hunting and sports ammunition.

BACKGROUND ART

All sorts of known ignition mixtures, which are presently used, i.e. both already dated mixtures based on mercuric fulminate, calcium chlorate and antimony sulphide, and newer non-corrosive mixtures based on tetrazene, lead trinitroresorcinate, lead dioxide, calcium silicide and antimony sulphide, emit during discharge a large amount of toxic heavy metals and they do not meet the environmental standards.

An example of such mixture is also the percussion ignition additive according to German patent No. 1 243 067, which contains 200 g of powdered metallic copper, 200 g of amorphous boron, 700 g of lead dioxide or powdered barium peroxide, 200 g of calcium silicide and 20 g of tetrazene.

The above-mentioned drawbacks of said mixtures are the reason why an extensive research has been carried out in the last ten years with an aim to develop a mixture that would not contain compounds of heavy metals such as lead, barium, mercury, antimony, and, at the same time, would retain non-corrosive properties of tricinate mixtures. The result is a mixture in which an aromatic diazo compound without metal content—dinol—fulfils the function of a primary explosive and tetrazene remains as a sensibilizer. The pyrotechnic system is in this case composed of a new oxidizing agent, zinc peroxide and titanium powder. The mixture can contain also other components such as friction agents, typically ground glass, and active propellants such as various sorts of nitrocellulose and nitroglycerine powders.

Mixtures based on dinol are also known in which basically only the pyrotechnic system is modified Oxidizing agents used include various oxides of metals—potassium nitrate, strontium nitrate, basic nitrates of copper and copper-ammonium nitrate and tin compounds. Neither these mixtures are a final solution.

U.S. Pat. No. 5,167,736 describes a primer mix containing dinol as the main explosive in combination with boron. Boron in this case is rather coarse-grained, about 120 mesh. The basic problem of such mixtures is the primary explosive itself—dinol. It is a carcinogenic compound with very unpleasant physiological effects. That is why there have been noted attempts to avoid dinol completely. EP 0656332 A1, in which the mixture is based only on pyrotechnic system and does not contain any explosive, offers one such solution. Here, the propellant is a hyperactive zircon powder, the oxidizing agent is a mixture of potassium nitrate and manganese dioxide, and the energy component is penthrite.

There is no doubt that this mixture is according to the data of the inventors fully functional even though here a serious problem can also arise. It can be zircon itself. As the inventors themselves state, the active form of zircon is ignited by the influence of minute energy impulse both mechanically and thermally. It is well known that highly active metal powders, especially zircon, are pyrophoric and extremely reactive. They react both with air oxygen creating oxides and with air nitrogen creating nitrides and also with humidity creating hydrides. During transportation and storage, they have to be stored under water and during the production of mixtures water must be displaced using a water-immiscible organic solvent. According to the inventors, isopropyl alcohol is the most advantageous. The technology is then based on classical embrocating of pasty mixture into primer caps, however with the difference that the bonding agent is not an aqueous solution of the given organic compound but a solution of aerosil in isopropyl alcohol. During the production and the feeding of such mixtures, serious problems can arise such as handling extremely reactive zircon and moreover also technological problems resulting from the use of large amounts of organic solvents during the production.

DISCLOSURE OF THE INVENTION

The above drawbacks are solved and totally removed by a non-toxic and non-corrosive ignition mixture the essence of which lies in that in the energy system, the primary explosive of the dinol type is replaced by a high explosive, which is activated by a sensibilizer of the tetrazene type or by salts and derivatives of tetrazoles. Nitroesters such as penthrite and hexanitromanite but also nitrocellulose in the form of granulate and also nitroamines such as hexogene, octogene and tetryle, can be used as the high explosive. In order to increase the ignition power, the mixture must be supplemented with an appropriate pyrotechnic system. Mixtures with powder boron turned out to be the most suitable, especially those with brown, so-called amorphous, boron with large specific surface which in the case of commonly available specimens reaches 5 to 25 $m^2/g$. Extensive testing has proven that amorphous boron is an excellent fuel and that it is able to create a perfect redox-system with any metal oxide, independent of valence, further with metal peroxides and all known salts of inorganic oxygen-containing acids.

Into the pyrotechnic system with boron, oxidizing agents can be selected from the group of compounds such as oxides of univalent metals: cuprous (I)—$Cu_2O$, bivalent: cupric (II)— CuO, zinc (II)—ZnO, oxides of multivalent metals: bismuth (III)—$Bi_2O_3$, bismuth (IV)—$BiO_2$ and bismuth (V)—$Bi_2O_5$, ferric (III)—$Fe_2O_3$, manganese (IV)—$MnO_2$, stannic (IV)—$SnO_2$, vanadic (V)—$V_2O_5$ and molybdenum (VI)—$MoO_3$, peroxides of zinc—$ZnO_2$ and calcium—$CaO_2$, saltpetre—$KNO_3$ and some special salts such as basic bismuth nitrates—$4BiNO_3(OH)_2.BiO(OH)$ and $BiONO_3.H_2O$, basic copper nitrate—$Cu(NO_3)_2.3Cu(OH)_2$, diammocopper nitrate—$Cu(NH_3)_2(NO_3)_2$, basic tin nitrate—$Sn_2O(NO_3)_2$. Boron creates the fastest burning system with compounds of bismuth. Systems with the highest heating effect originate when potassium nitrate, cupric oxide, ferric oxide and manganese oxide are used. The products of combustion can be both low-melting boron (III) oxide—$B_2O_3$ and volatile boron (II) oxide—BO which is more stabile at higher temperatures, possibly also boron nitride—BN. The presence of these compounds in the products of combustion is very desirable from the viewpoint of perfect ignition of powder cartridge charges. In spite of its extraordinary reactivity, boron is chemically stable and it is not dangerous for handling. The expenses related to boron are compensated by its minimal content in stoichiometric mixtures, which does not exceed 20 weight percent. In order to increase sensitivity to strike by a blow, it is necessary to supplement the mixture with an appropriate friction agent, which is ground glass.

Considering that ignition mixtures produced in this way are in a very fine form it seems that the most suitable technology is handling when wet and, therefore, the mixture can also contain a certain amount of a water-soluble bonding agent. Commonly known bonding agents such as acacia gum, dextrin, polyvinyl alcohol, carboxymethyl cellulose and others are the most suitable. Should it be necessary to handle the mixture when dry, it would need to be granulated first. Granulation can be done both by using the above-mentioned bonding agents in water solutions or by using bonding agents soluble in organic solvents, e.g. nitrocellulose in acetone. The pyrotechnic system can be also grained after pressing and the grained product can be later used in the mixtures. In this case, the mixture does not have to contain any bonding agent because it can be easily fed when dry.

Within several years extensive tests have been performed both with primer caps filled with mixtures of the invention and with ammunition equipped with these primer caps. The results of said functional tests show that it is possible, by a suitably chosen combination of the energy and pyrotechnic systems, to achieve desired characteristics of the mixture for a particular type of the primer. For example, for the smallest types of primer caps having the shortest reaction times, destined for the pistol and revolver ammunitions, it is necessary that the energy and pyrotechnic systems show as high reactivity as possible and have a high energy content at the same time. Primers showing the highest reactivity include nitro esters, which can be most easily initiated, among them mainly mannite hexanitrate, which is however predestined for special use due to its high cost and somewhat lower chemical stability. On the other hand, penthrite has shown itself as an ideal explosive with a wide range of utility. Similarly, nitrocellulose is a universal and multipurpose explosive, which can play roles of the combustible, the propellant and the binder at the same time. Nitramines are at a lower level in terms of effect than nitro esters and their initiability is lower. This renders them useful in primer caps having larger dimensions and longer reaction times, wherein they can be applied better than nitro esters, the very high effect of which could even be disadvantageous in some cases.

For comparison, results are presented of measurements of the primer caps 4.4/0.4 BOXER, destined for cartridges 9 mm LUGER, by the method DROP-TEST, in which we obtained a graphical function of the pressure values in dependence on the reaction time of the primer. The mixture of Example 20 was compared to a classical mixture based on lead trinitroresorcinate, the charge of which in the primer cap is by about 20% higher. For both mixtures, identical values were obtained for maximal pressures—100 bars—and reaction times—100 microseconds.

Parameters of inner ballistics of the cartridge 9 mm LUGER with the primer cap filled with the above-described mixture were also measured. When a suitably chosen powder is used, it is possible, for a bullet weighing 7.5 g, to achieve muzzle velocities about 420 m/s without exceeding admissible values of maximal pressures in the chamber. Besides, functional shootings from various types of short and automatic weapons were performed, wherein the inventive ammunition showed reliable functioning.

It has been found that the mixtures of the invention, which contain tetrazene as the main explosive, show extraordinary handling safety. During burning of this mixture no development has been observed of any toxic combustion gases or compounds able to cause corrosion of the weapon.

Ignition mixtures created by combination of energy and pyrotechnic systems according to the mentioned essence of the invention are expressed by the following scheme:

| | data are presented in weight percentages |
|---|---|
| high explosive | 5 to 40% |
| senzibilizer | 5 to 40% |
| oxidizing agent | 5 to 50% |
| boron | 1 to 20% |
| friction agent | 5 to 30% |
| possible bonding agent | 0.1 to 5% |

EXAMPLES

The make is presented in weight percentages.

Example 1 mixture without a bonding agent, suitable for handling when dry

| | |
|---|---|
| tetrazene | 25% |
| penthrite | 25% |
| $4BiNO_3(OH)_2.BiO(OH)$ | 36.4% |
| B | 3.6% |
| ground glass | 10% |

Example 2 similar mixture with higher sensitivity

| a) dry variant without bonding agent | |
|---|---|
| tetrazene | 35% |
| penthrite | 05% |
| $4BiNO_3(OH)_2.BiO(OH)$ | 18% |
| B | 2% |
| glass | 10% |
| **b) wet variant** | |
| tetrazene | 35% |
| penthrite | 05% |
| $4BiNO_3(OH)_2.BiO(OH)$ | 18% |
| B | 2% |
| acacia gum | 0.5% |
| glass | 19.5% |

Example 3 similar mixture

| a) dry variant | |
|---|---|
| tetrazene | 25% |
| penthrite | 25% |
| $BiONO_3.H_2O$ | 34% |
| B | 5.5% |
| glass | 10% |
| nitrocellulose | 0.5% |

-continued

| b) wet variant | |
|---|---|
| tetrazene | 25% |
| tetryle | 25% |
| $BiONO_3.H_2O$ | 34% |
| B | 5.5% |
| acacia gum | 0.5% |
| glass | 10% |

Example 4 mixture with higher heating effect

| a) dry variant - without bonding agent | |
|---|---|
| tetrazene | 35% |
| penthrite | 15% |
| CuO | 34% |
| B | 6% |
| glass | 10% |
| **b) wet variant** | |
| tetrazene | 25% |
| penthrite | 25% |
| CuO | 34% |
| B | 5.5% |
| polyvinyl alcohol | 0.5% |
| glass | 10% |

Example 5

| a) dry variant | |
|---|---|
| tetrazene | 35% |
| penthrite | 15% |
| $Bi_2O_3$ | 36% |
| B | 3.5% |
| nitrocellulose | 0.5% |
| glass | 10% |
| **b) wet variant** | |
| tetrazene | 25% |
| hexogene | 25% |
| $Bi_2O_3$ | 36% |
| B | 3.5% |
| polyvinyl alcohol | 0.5% |
| glass | 10% |

Example 6

| a) dry variant | |
|---|---|
| tetrazene | 35% |
| penthrite | 15% |
| $MnO_2$ | 31.5% |
| B | 8% |
| nitrocellulose | 0.5% |
| glass | 10% |

-continued

| b) wet variant | |
|---|---|
| tetrazene | 25% |
| tetryle | 25% |
| $MnO_2$ | 31.5% |
| B | 8% |
| acacia gum | 0.5% |
| glass | 10% |

Example 7

| a) dry variant | |
|---|---|
| tetrazene | 25% |
| penthrite | 25% |
| ZnO | 34% |
| B | 5.5% |
| nitrocellulose | 0.5% |
| glass | 10% |
| **b) wet variant** | |
| tetrazene | 25% |
| penthrite | 25% |
| ZnO | 34% |
| B | 5.5% |
| acacia gum | 0.5% |
| glass | 10% |

Example 8 only dry variant

| | |
|---|---|
| tetrazene | 25% |
| penthrite | 25% |
| $Fe_2O_3$ | 34% |
| B | 5.5% |
| nitrocellulose | 0.5% |
| glass | 10% |

Example 9

| a) dry variant | |
|---|---|
| tetrazene | 25% |
| penthrite | 25% |
| $V_2O_5$ | 30% |
| B | 9.5% |
| nitrocellulose | 0.5% |
| glass | 10% |
| **b) wet variant** | |
| tetrazene | 25% |
| penthrite | 25% |
| $V_2O_5$ | 30% |
| B | 9.5% |
| acacia gum | 0.5% |
| glass | 10% |

Example 10

| a) dry variant | |
|---|---|
| tetrazene | 35% |
| penthrite | 15% |
| $SnO_2$ | 34% |
| B | 5.5% |
| nitrocellulose | 0.5% |
| glass | 10% |
| **b) wet variant** | |
| tetrazene | 25% |
| penthrite | 25% |
| $SnO_2$ | 34% |
| B | 5.5% |
| acacia gum | 0.5% |
| glass | 10% |

Example 11

| a) dry variant | |
|---|---|
| tetrazene | 25% |
| penthrite | 25% |
| $MoO_3$ | 30% |
| B | 9.5% |
| nitrocellulose | 0.5% |
| glass | 10% |
| **b) wet variant** | |
| tetrazene | 25% |
| penthrite | 25% |
| $MoO_3$ | 30% |
| B | 9.5% |
| acacia gum | 0.5% |
| glass | 10% |

Example 12

| a) dry variant | |
|---|---|
| tetrazene | 25% |
| penthrite | 25% |
| $ZnO_2$ | 30% |
| B | 9.5% |
| nitrocellulose | 0.5% |
| glass | 10% |
| **b) wet variant** | |
| tetrazene | 25% |
| tetryle | 25% |
| $ZnO_2$ | 30% |
| B | 9.5% |
| polyvinyl alcohol | 0.5% |
| glass | 10% |

Example 13 only dry variant

| | |
|---|---|
| tetrazene | 25% |
| hexogene | 25% |

-continued

| | |
|---|---|
| $CaO_2$ | 30% |
| B | 9.5% |
| nitrocellulose | 0.5% |
| glass | 10% |

Example 14 only dry variant—mixture with higher heating effect

| | |
|---|---|
| tetrazene | 25% |
| penthrite | 25% |
| $KNO_3$ | 33.5% |
| B | 6% |
| nitrocellulose | 0.5% |
| glass | 10% |

Example 15

| a) dry variant | | b) wet variant | |
|---|---|---|---|
| tetrazene | 35% | tetrazene | 25% |
| penthrite | 15% | hexogene | 25% |
| $Cu(NO_3)_2.3Cu(OH)_2$ | 31.5% | $Cu(NO_3)_2.3Cu(OH)_2$ | 31.5% |
| B | 8% | B | 8% |
| nitrocellulose | 0.5% | acacia gum | 0.5% |
| glass | 10% | glass | 10% |

Example 16

| a) dry variant | | b) wet variant | |
|---|---|---|---|
| tetrazene | 35% | tetrazene | 25% |
| penthrite | 15% | hexogene | 25% |
| $Cu(NH_3)_2(NO_3)_2$ | 27.5% | $Cu(NH_3)_2(NO_3)_2$ | 27.5% |
| B | 12% | B | 12% |
| nitrocellulose | 0.5% | acacia gum | 0.5% |
| glass | 10% | glass | 10% |

Example 17 with highly reactive oxidizing agent

| a) dry variant | | b) wet variant | |
|---|---|---|---|
| tetrazene | 25% | tetrazene | 25% |
| penthrite | 25% | hexogene | 25% |
| $BiO_2$ | 33.5% | $BiO_2$ | 33.5% |
| B | 6% | B | 6% |
| nitrocellulose | 0.5% | acacia gum | 0.5% |
| glass | 10% | glass | 10% |

Example 18 analogous mixture

| a) dry variant | | b) wet variant | |
|---|---|---|---|
| tetrazene | 25% | tetrazene | 25% |
| penthrite | 25% | tetryle | 25% |
| $Bi_2O_5$ | 33% | $Bi_2O_5$ | 33% |
| B | 6.5% | B | 6.5% |
| nitrocellulose | 0.5% | acacia gum | 0.5% |
| glass | 10% | glass | 10% |

Example 19 a specific case where oxidizing agent works as auxiliary explosive

| a) dry variant | | b) wet variant | |
|---|---|---|---|
| tetrazene | 25% | tetrazene | 25% |
| penthrite | 25% | hexogene | 25% |
| $Sn_2O(NO_3)_2$ | 32% | $Sn_2O(NO_3)_2$ | 31.5% |
| B | 8% | B | 8% |
| glass | 10% | acacia gum | 0.5% |
| | | glass | 10% |

Example 20 use of two oxidizing agents

| | |
|---|---|
| tetrazene | 30% |
| penthrite | 7.5% |
| $4BiONO_3(OH)_2.BiO(OH)$ | 18% |
| $KNO_3$ | 17% |
| B | 5% |
| nitrocellulose | 0.5% |
| glass | 22% |

INDUSTRIAL APPLICABILITY

Mixtures that are in accordance with technical solution are utilizable in the field of ammunition production for the production of primers for central ignition cartridges intended for sports, hunting and practice purposes, or for shooting cartridges.

What is claimed is:

1. A non-toxic and non-corrosive ignition mixture wherein the mixture comprises from 5 to 40 weight percent of a nitroester or nitramine explosive;

from 5 to 40 weight percent of tetrazene;

from 5 to 50 weight percent of an oxidizing agent, selected from the group consisting of oxides of copper, zinc, bismuth, iron, manganese, tin, vanadium or molybdenum; peroxides of zinc or calcium; saltpetre; basic nitrates of bismuth, tin or copper; and $Cu(NH_3)_2(NO_3)_2$;

from 1 to 20 weight percent of amorphous boron as a fuel;

from 5 to 30 weight percent of a friction agent;

wherein said mixture is free of dinol.

2. The mixture according to claim 1 wherein said explosive is selected from the group consisting of penthrite, hexanitromannite, nitrocellulose, hexogene, octogene, and tetryle.

3. The mixture according to claim 2 wherein said explosive is penthrite.

4. The mixture according to claim 2 wherein said amorphous boron has a specific surface area of 5 to 25 $m^2/g$.

5. The mixture according to claim 2 wherein said friction agent is ground glass.

6. The mixture according to claim 2 further comprising from 0.1 to 5 weight percent of a bonding agent.

7. The mixture according to claim 6 wherein said bonding agent is polyvinyl alcohol, or acacia gum.

8. The mixture according to claim 6 wherein said bonding agent is nitrocellulose.

9. The mixture according to claim 1 wherein said amorphous boron has a specific surface area of 5 to 25 $m^2/g$.

10. The mixture according to claim 1 wherein the friction agent is ground glass.

11. A primer cap for an ammunition cartridge filled with the mixture of claim 1.

12. The primer cap of claim 11 wherein said ammunition cartridge is a central ignition cartridge.

13. An ammunition cartridge comprising the primer cap of claim 11.

14. An ammunition cartridge comprising the primer cap of claim 12.

15. The mixture according to claim 1 further comprising from 0.1 to 5 weight percent of a bonding agent.

16. The mixture according to claim 15 wherein the bonding agent is selected from polyvinyl alcohol and acacia gum.

17. The mixture according to claim 15 wherein said bonding agent is nitrocellulose.

* * * * *